United States Patent [19]

Mueller

[11] 4,147,951

[45] Apr. 3, 1979

[54] GAS DISCHARGE LAMP HAVING A DOUBLE ELECTRODE ARRANGEMENT

[75] Inventor: Gerd Mueller, Mainz, Fed. Rep. of Germany

[73] Assignee: JENAer Glaswerk Schott & Gen., Fed. Rep. of Germany

[21] Appl. No.: 869,691

[22] Filed: Jan. 16, 1978

[30] Foreign Application Priority Data

Jan. 15, 1977 [DE] Fed. Rep. of Germany ..... 2701541

[51] Int. Cl.[2] ..... H01J 61/30

[52] U.S. Cl. ..... 313/220; 313/204

[58] Field of Search ..... 313/220, 204

[56] References Cited

U.S. PATENT DOCUMENTS

| | | | |
|---|---|---|---|
| 2,123,709 | 7/1938 | Bristow et al. | 313/220 |
| 3,271,612 | 9/1966 | Keller | 313/220 |
| 3,609,436 | 9/1971 | Campbell | 313/204 |

FOREIGN PATENT DOCUMENTS 2254709 5/1974 Fed. Rep. of Germany.

2319401 11/1974 Fed. Rep. of Germany.

*Primary Examiner*—Palmer C. Demeo
*Assistant Examiner*—Darwin R. Hostetter
*Attorney, Agent, or Firm*—Hill, Gross, Simpson, Van Santen, Steadman, Chiara & Simpson

[57] ABSTRACT

A gas discharge lamp is disclosed having a double electrode arrangement in a discharge space. The discharge space is defined by a glass tube sealed in gas-tight fashion and which is subdivided approximately along a longitudinal center-line by a separation plate. One end of the tube is open and receives an insulating disc through which lead wires for the electrodes pass. The insulating disc is connected in gas-tight fashion to the tube. The separation plate extends from the insulating disc towards the opposite end of the tube and terminates at a point spaced from the end of the tube. Accordingly, gas-tight discharge half spaces are formed at both sides of the separation plate with a connecting discharge space at the end of the tube which is not subdivided by the separation plate.

5 Claims, 2 Drawing Figures

GAS DISCHARGE LAMP HAVING A DOUBLE ELECTRODE ARRANGEMENT

BACKGROUND OF THE INVENTION

The subject of the invention is a gas discharge lamp having a double electrode arrangement in which the discharge space is formed by a glass tube which is subdivided approximately in the center with a separation plate along the largest part of its length.

Mercury vapor low pressure discharge lamps generally have a discharge space which is formed by a glass tube. The length of the discharge path is therefore equal to the length of the tube, limited practically by its handling and mechanical sensitivity. In order to lengthen the discharge path without great handling problems, U-shaped, W-shaped or meandrous tube shapes were suggested and also employed for special uses in illumination technology.

The form of the discharge tube in gas discharge lamps for d.c. current operation is of particular importance. There, particularly in lamps with discharge paths over about 60cm (at a tube diameter of 37 mm), the appearance of a cataphoresis occurs, i.e., a concentration of the metal vapor in the cathode volume, which leads to an uneven light output and a decreased light efficiency. In order to avoid this effect, for example, the German Pat. Nos. 2,254,709 and 2,319,401 suggested lamp constructions having a so-called double electrode arrangement in which the electrodes are closely adjacent. The two electrode spaces are gas or metal vapor permeably connected with one another but are also connected with one another in discharge-tight fashion. These German patents show that the discharge volume is enclosed by a glass tube shaped into a closed or sealed form whose cross section is interrupted at one location in discharge-tight fashion, but, however, is gas or metal vapor permeably interrupted or narrowed down such that the electrodes are arranged at both sides close to this interruption or narrowing down location.

With the aid of such an embodiment, the discharge path for equal constuction lengths of the lamp is at least doubled and the effects of cataphoresis for d.c. current operation is eliminated. However, the embodiment having a double electrode arrangement is considerably more expensive in production. Aside from the requirement of the tube bending or the joining of a tube consisting of several individual parts, this expense holds true primarily for the electrode arrangement per se, because the narrowing-down or the gas-permeable interruption of the discharge space must be situated between the electrodes, the feed-lines of the electrodes must be conveyed through the tube wall in gas-tight fashion and, moreover, at least one opening, preferably in the form of a pump tube for the evacuation and filling of the discharge lamp, must be attached.

The German application P 26 56 776.0 provides a simple production arrangement of the components in the electrode region which can be relatively simply realized, utilizing a solder glass technique. However, this construction also contains the basic difficulty that a discharge space has to be formed from a correspondingly bent tube while inserting an electrode part. This discharge space must be closed at all sides and gas-tight with respect to the exterior.

SUMMARY OF THE INVENTION

It is an object of the invention to provide a gas discharge lamp in which the requirements for an extended discharge path, double electrode arrangement and, if necessary, a cataphoresis suppression are fulfilled in a simple production manner.

This objective is achieved wherein the cross section of a straight tube piece is partitioned into two approximately equal halves through almost the total length of the tube by means of a separation plate arranged in the longitudinal axis of the tube. At a first end, the separation plate closes flush with the tube end and at the other second end, the tube projects by an amount which corresponds with the size of its diameter. This projecting end can be tapered into a pump tube or can be directly melted-off.

At the first end of the tube, the feed lines for the respective electrodes are conveyed in gas-tight fashion on each side of the separation plate through a base plate which is connected in gas-tight fashion to the tube and the separation plate in a glass melt technique or with the aid of a solder glass technique. If necessary, the base plate can also accommodate one, or for both electrode spaces, two pump tubes. In that case, the pump tube can also contain the feed lines of the electrodes in a pinched base technique. The separation plate is rigidly connected to the tube. This connection can rigidly be effected with the aid of a solder glass intermediate layer. However, it can also be obtained by clamping the separation plate. The direct clamping, however, harbors the danger of impermissible mechanical stresses. This can be prevented in that the narrow lateral surfaces of the separation plate are provided with a coating of flexible glass fiber felt. This coating, for its part, can be cemented to the separation plate with glass solder, water glass, or a similar inorganic cement. The connection between separation plate and tube wall need not be gas-tight, but only discharge tight. In case of a DC current operation, an incomplete sealing between separation plate and tube wall, at least in the vicinity of the electrodes is even expedient as therefore the influence of a cataphoresis can be very simply eliminated.

The separation wall can consist of an arbitrary, electrically insulating material, whose thermal expansion matches with that of the glass tube utilized. As a rule, the separation wall will also be produced of a glass. In vacuum tube fluorescent lamps preferably not only the tube interior wall, but also the surface of the separation plate is coated with a fluorescent substance. This coating preferably results directly after inserting and attaching the separation plate utilizing a conventional technique.

The seal at the electrode sides expediently results with the utilization of a pre-shaped component. The component is essentially a disc through which the feed lines of the electrodes are conveyed in gas-tight fashion in the axial direction. This electrode disc can consist of glass or sintered glass or also of a ceramic material.

With glass, the electrode feed lines can be directly melted-in, and, in glass and ceramics, the feed lines can be soldered into corresponding bores of the disc with a solder glass.

The diameter of the electrode disc is to correspond approximately with the diameter of the glass tube. In order to connect the disc with the tube, one side of the disc is preferably coated with solder glass. The tube is connected in gas-tight fashion to the disc via this intermediate coating. A connection between the separation plate and the disc is simultaneously produced. One embodiment is particularly economical for production, in which the electrode disc consists totally of solder glass so that an additional coating of the disc can be spared.

A glass melt connection in the technique conventional for standard vacuum tube lamps can also be utilized, as the geometric proportions at the electrode end of the inventive lamp differ from the ones of standard vacuum tube lamps only in that the number of the electrode supply lines is doubled. Also, the tube cross-section is subdivided by the separation plate to which, however, for reasons mentioned earlier, a gas-tight connection need not necessarily be produced.

The electrode disc can additionally contain pump tubes for the two electrode volumes in addition to the electrode feed lines. The evacuation of the lamp and the filling with the operating gas, however, can also be undertaken from the other end of the tube which preferably tapers into a pumping shaft.

Preheatable tungsten circular coil electrodes or cold starting electrodes can also be employed as electrodes.

Between the end of the separation plate and the melted tube end 6 a free space is situated.

Figure 1:
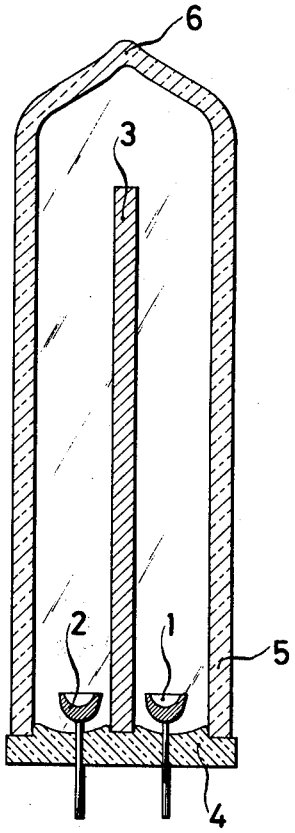
FIG. 1 and FIG. 2 illustrate in sectional view a lamp to be operated with cold starting electrodes. The electrodes 1 and 2 are arranged at both sides of the separation plate. The electrode feed lines are conveyed through a solder glass plate 4, which is connected in gas-tight fashion to the tube end 5. The separation plate 3 is also connected to the solder glass plate, however not necessarily in gas-tight fashion. The tube end 6 at the opposite side is first tapered into a pumping tube and is subsequently melted with the operating gas after the lamp is filled.
Figure 2:
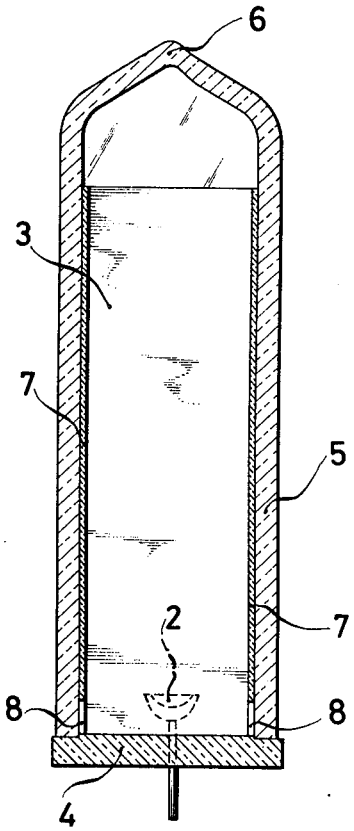

During the operation of the lamp, the discharge column extends from electrode to electrode through this free space and the two half tubes. The effect of a cataphoresis with DC current operation is greatly reduced in that the separation plate in the proximity of the electrodes is intentionally not gas-tight, but rather is connected in discharge-tight fashion to the tube wall. FIG. 2 illustrates this with the aid of the same tube as in FIG. 1 in a cross section rotated by 90°. The connection between separation plate 3 and tube wall 5 is there produced on the narrow sides of the separation plate via a solder glass coating 7. In the proximity of the electrodes 8, this coating was intentionally omitted at certain points so that a narrow gap is formed between the electrode spaces. The connection between the electrode spaces can also be produced at the border area between separation plate 3 and base plate 4 across a gap or a channel.

It is obvious that the inventive lamps can be built into standard vacuum tube lamps with only minor alterations of the circuit layout on the basis of their elongated type of construction and electrode arrangement. This is a particular advantage over other types of construction which are based on closed tube shapes. The inventive type of construction also facilitates a simple connection with an Edison socket or mounting, and thus is a replacement for incandescent lamps. The main connecting devices or power supply units necessary for DC current or AC current operation can therefore be integrated into the base of the socket so that a particularly handy, compact form results which can be directly exchanged with incandescent bulbs.

Although various minor modifications may be suggested by those versed in the art, it should be understood that I wish to embody within the scope of the patent warranted hereon, all such embodiments as reasonably and property come within the scope of my contribution to the art.

I claim as my invention:

1. A gas discharge lamp, comprising: first and second electrodes; an elongated glass tube having a closed end and an open end opposite the closed end; a separate electrically insulating substantially planar disc mounted in gas-tight sealed fashion in the tube open end; electrical lead-in wires positioned through the insulating disc connecting and supporting said electrodes; a separation plate having one end connected in gas-tight fashion to the insulating disc between the electrodes, entire side edges of the separation plate connecting in gas-tight fashion to sides of the glass tube except for a portion of at least one of the side edges adjacent the insulating disc at which is provided a gas-permeable discharge-tight aperture means for cataphoresis suppression, and the separation plate extending from the insulating disc along a length of the tube and terminating at a point spaced from the closed end so as to form first and second discharge tight half spaces and a connecting discharge space communicating between the first and second half spaces.

2. The lamp of claim 1 wherein the glass tube open end is circular and of the same diameter as the tube, and the disc is circular.

3. The lamp of claim 2 wherein the gas-tight connections are solder glass.

4. The lamp of claim 3 wherein the disc comprises solder glass.

5. The lamp of claim 2 wherein the closed end comprises a pinched off pumping shaft.

* * * * *